US009775206B2

(12) United States Patent
Yang et al.

(10) Patent No.: US 9,775,206 B2
(45) Date of Patent: Sep. 26, 2017

(54) LED AC DRIVE CIRCUIT

(71) Applicant: SICHUAN SUNFOR LIGHT CO., LTD., Sichuan (CN)

(72) Inventors: Mian Yang, Sichuan (CN); Zhengyong Feng, Sichuan (CN); Wentao Long, Sichuan (CN); Dongming Li, Sichuan (CN)

(73) Assignee: SICHUAN SUNFOR LIGHT CO., LTD, Sichuan (CN)

( * ) Notice: Subject to any disclaimer, the term of this patent is extended or adjusted under 35 U.S.C. 154(b) by 0 days.

(21) Appl. No.: 14/913,563

(22) PCT Filed: Aug. 22, 2014

(86) PCT No.: PCT/US2014/084991
§ 371 (c)(1),
(2) Date: Feb. 22, 2016

(87) PCT Pub. No.: WO2015/024529
PCT Pub. Date: Feb. 26, 2015

(65) Prior Publication Data

US 2016/0360586 A1 Dec. 8, 2016

(30) Foreign Application Priority Data

Aug. 23, 2013 (CN) ..... 2013 1 0373427

(51) Int. Cl.
*H05B 37/00* (2006.01)
*H05B 33/08* (2006.01)

(52) U.S. Cl.
CPC ..... *H05B 33/0845* (2013.01); *H05B 33/083* (2013.01); *H05B 33/0815* (2013.01);
(Continued)

(58) Field of Classification Search
CPC ..... H05B 33/0809; H05B 33/0815; H05B 33/0824; H05B 33/083; H05B 33/0845; H05B 33/0887; H05B 33/089
(Continued)

(56) References Cited

U.S. PATENT DOCUMENTS 9,155,149 B2 * 10/2015 Pan ..... H05B 33/0824
2011/0068700 A1 * 3/2011 Fan ..... H05B 33/0818 315/185 R
(Continued)

FOREIGN PATENT DOCUMENTS

CN 101668373 A 3/2010
CN 102045923 A 5/2011
(Continued)

OTHER PUBLICATIONS

International Search Report, International Patent Application No. PCT/CN2014/084991, dated Oct. 15, 2014.

*Primary Examiner* — Tung X Le
(74) *Attorney, Agent, or Firm* — Michael Ye; Andrews Kurth Kenyon LLP

(57) ABSTRACT

An LED AC drive circuit, comprising: a rectification unit, a current-limiting unit, M LED units and M−1 connected/disconnected control connection lines; each LED unit comprising ni LEDs connected in series, wherein 1≤i≤M, and n1+n2+ . . . +nM=N, 1≤M≤N, and N is determined by formula (I). The M LED units are connected sequentially to the positive end of the rectification unit and to the current-limiting unit connected to the negative end of the rectification unit; the first LED unit comprises switches connected in series at the negative end of the LED string; the ith LED unit comprises switches connected in series at the positive end of the LED string and switches connected in series at the negative end of the LED string, wherein 1≤i≤M−1; and the
(Continued)

Mth LED unit comprises switches connected in series at the positive end of the LED string.

14 Claims, 8 Drawing Sheets

(52) U.S. Cl.
CPC ..... *H05B 33/0824* (2013.01); *H05B 33/0827* (2013.01); *H05B 33/0884* (2013.01)

(58) Field of Classification Search
USPC ..... 315/186, 193
See application file for complete search history.

(56) References Cited

U.S. PATENT DOCUMENTS

| | | | | |
|---|---|---|---|---|
| 2011/0127922 | A1* | 6/2011 | Sauerlaender ..... | H05B 33/0809 315/192 |
| 2012/0176826 | A1* | 7/2012 | Lazar ..... | H02M 3/158 363/126 |
| 2013/0162149 | A1* | 6/2013 | van de Ven ..... | H05B 33/0824 315/186 |
| 2015/0002035 | A1* | 1/2015 | Schie ..... | H01L 27/0817 315/200 R |
| 2015/0061499 | A1* | 3/2015 | Hattrup ..... | H05B 33/0815 315/122 |

FOREIGN PATENT DOCUMENTS

| | | | |
|---|---|---|---|
| CN | 102316648 | A | 1/2012 |
| CN | 103188845 | A | 7/2013 |
| CN | 103200728 | A | 7/2013 |

* cited by examiner

LED AC DRIVE CIRCUIT

This application claims priority to Chinese Patent Application No. 201310373427.1 filed on Aug. 23, 2013 before State Intellectual Property Office of China, titled "AC LED DRIVING CIRCUIT", and the entire contents of which are incorporated herein by reference.

TECHNICAL FIELD

The present invention relates to the technical field of Light Emitting Diode (LED) driving circuit, and in particular to an Alternating Current (AC) LED driving circuit.

BACKGROUND

Recently, environmental protection and energy conservation have received widespread attention from all sectors of society. In the lighting field, people's environmental protection and energy conservation awareness is expressed as mass use of LED lighting products having particular energy-saving advantages.

In prior arts, driving circuits for LED lighting products generally employ a conventional switch-mode constant current power supply technology (AC-DC). The lifetimes of these driving circuits are far shorter than the lifetimes of the LED themselves. This leads to that the LED lighting products are inferior to the conventional energy-saving lamps in terms of real lifetime. Thus, there is proposed a first-generation AC LED driving technology in which LEDs are directly input with AC mains supply. This technology is capable of solving the lifetime problem in conventional driving power supplies, but has a very low driving efficiency, usually lower than 70%, while the switch-mode constant current power supply usually has a driving efficiency of greater than 80%. Further, in the first-generation AC LED driving technology, the working currents of LEDs frequently change, and a surge occurs in each cycle of the AC mains supply, which is bad for the lifetimes of LEDs and meanwhile causes reduced light emitting efficiency of LEDs and significant flicker viewed by people's eyes with the fluctuations of the mains supply.

Aiming at the above defects of the first-generation AC LED driving technology, there is proposed a second-generation AC LED driving technology. In this technology, previous single LED string is divided into a plurality of units each of which is formed by one or more LEDs connected in series, and a ground switch is provided for each unit, and then a current-limiting device is provided. During operation, a control circuit detects input voltage values, and selects one of switches to be turned on according to the voltage values. The advantages of the driving technology are as follows. The AC mains supply presents a sinusoidal waveform in which voltage changes over time. When the voltage is relatively low, the first unit is powered on; when the voltage rises, two units, i.e., the first and second units, are powered on; when the voltage starts to fall down, the first unit is powered on again, and so on. Thus, the driving efficiency is increased from previous lower than 70% to 90%. Meanwhile, because current-limiting technology is used, a peak value of the current flowing through LEDs is limited, and thus LEDs are protected, and thereby the problem of significant flicker viewed by people's eyes with the fluctuations of the AC mains supply is solved.

Although the second-generation AC LED driving technology solves the problems with the first-generation technology, the second-generation technology still has some shortcomings. For example, according to the present market demands, it is desired that LED lighting products can be compatible with conventional TRIAC dimmer to realize a dimming function. It is hard for conventional switch-mode constant current power supply to satisfy such demands, because the dimmable switch-mode constant current power supplies available on the market have bad dimming effects (flicker is generated). Also, the first-generation AC LED driving technology cannot meet the demands because there are dramatic sudden changes in brightness (sudden brightening or darkening). For the second-generation AC LED driving technology, there is no dramatic flicker and sudden change in the brightness during dimming, and however a phenomenon where LEDs in a lot of units are not powered on occurs during the dimming, and this results in that a part of the light outgoing surface do not have light. As a result, although brightness adjustment is realized, light output is influenced.

Further, in the second-generation AC LED driving technology, the number of working LEDs varies in different time periods, and all the LEDs emit light only in very little time. As a result, the LEDs are not fully utilized.

Further, even though the second-generation AC LED driving technology employs the current-limiting technology, the technology does not address the problem of the output light brightness of LED lighting products. That is to say, depending on how many units are divided into, there will be brightness stages the number of which is double of the number of the divided units (the brightness is constant within a certain time period, and when the voltage rises, the brightness will rise accordingly to a certain value and then remain at this value).

Further, same as the first-generation technology, if using the second-generation AC LED driving technology, one type of product can work under only one grid voltage. For example, if an AC product of 110V works in an electrical grid of 220V, the brightness and power of the LED product will increase and even get damaged. Similarly, if a product of 220V works in a grid of 110V, the power and brightness of the product will be reduced and the product may even become dark.

Thus, it is desired to develop an AC LED driving circuit which is capable of accomplishing the advantages of the second-generation AC technology, and meanwhile keeping constant light output of LEDs without brightness stages. Further, it is also desired that the AC LED driving circuit can work under different grid voltages as conventional switch-mode constant power supplies and remain at constant power and brightness.

SUMMARY

The present invention is intended to provide an AC LED driving circuit, including:

a rectifier unit input with AC mains supply to rectify mains supply and output pulse Direct Current (DC) electricity;

a current-limiting unit connected in series in the circuit to limit current amplitude in the circuit;

M LED units, each of which includes an LED string of ni LEDs connected in series, $1 \le i \le M$, $n1+n2+ \ldots +nM=N$, $1 \le M \le N$, wherein N is determined by the following equation:

$$N = \frac{\sqrt{2}\,V_{in}}{V_f}$$

wherein Vin is AC mains supply voltage, Vf is a diode voltage drop of a single LED, wherein the M LED units are arranged sequentially, each of which has: a terminal, which is close to a positive terminal of its LED string, connected to a positive terminal of the rectifier unit; and another terminal, which is close to a negative terminal of its LED string, connected to the current-limiting unit which is connected to a negative terminal of the rectifier unit; wherein, among the M LED units, a first LED unit includes a switch connected in series with a negative terminal of an LED string in the first LED unit, an i-th LED unit includes a switch connected in series with a positive terminal of an LED string in the i-th LED unit and a switch connected in series with a negative terminal of the LED string in the i-th LED unit, $1 \leq i \leq M-1$, and an M-th LED unit includes a switch connected in series with a positive terminal of an LED string in the M-th LED unit; and M−1 connection lines for on/off control, each of which has a terminal connected with the negative terminal of the LED string in the i-th LED unit, and another terminal connected with a positive terminal of an LED string in an (i+1)-th LED unit, $1 \leq i \leq M-1$, wherein on or off of the M−1 connection lines determines layouts of the circuit;

wherein series and parallel connection states of respective LED units are changed by changing closed and open states of respective switches and on and off states of the connection lines, so that all LEDs normally work over respective voltage ranges of pulse DC electricity.

According to an aspect of the present invention, the AC mains supply voltage is 220V, the diode voltage drop of each LED is 3.2 V, N=96, and M=4.

According to another aspect of the present invention, the first LED unit includes a switch S1 connected in series with the negative terminal of the LED string in the first LED unit; a second LED unit includes a switch S3 connected in series with a positive terminal of an LED string in the second LED unit and a switch S4 connected in series with a negative terminal of an LED string in the second LED unit; a third LED unit includes a switch S6 connected in series with a positive terminal of an LED string in the third LED unit and a switch S7 connected in series with a negative terminal of an LED string in the third LED unit; and a fourth LED unit includes a switch S9 connected in series with a positive terminal of an LED string in the fourth LED unit.

According to another aspect of the present invention, there are three connection lines for on/off control in the circuit which are switches S2, S5 and S8, respectively. The switch S2 has a terminal connected with the negative terminal of the LED string in the first LED unit, and another terminal connected with the positive terminal of the LED string in the second LED unit; the switch S5 has a terminal connected with the negative terminal of the LED string in the second LED unit, and another terminal connected with the positive terminal of the LED string in the third LED unit; and the switch S8 has a terminal connected with the negative terminal of the LED string in the third LED unit, and another terminal connected with the positive terminal of the LED string in the fourth LED unit.

According to another aspect of the present invention, during rising of voltage of the pulse DC electricity from 0V to V1', the switches S2, S5 and S8 are open, and other switches are closed, so that the first LED unit, the second LED unit, the third LED unit and the fourth LED unit are connected in parallel; during rising of the voltage of the pulse DC electricity from V1' to V2', the switches S2, S4, S6 and S8 are closed, and the switches S1, S3, S5, S7 and S9 are open, so that the first LED unit and the second LED unit are connected in series, and the third LED unit and the fourth LED unit are connected in series, and then two resulting unit strings are connected in parallel; during rising of the voltage of the pulse DC electricity from V2' to Vmax', the switches S2, S5 and S8 are closed, and other switches are open, so that the first LED unit, the second LED unit, the third LED unit and the fourth LED unit are connected in series; wherein V1' and V2' are particular voltages in rising edges of the pulse DC electricity, V1'<V2', and values of V1' and V2' allow all the LED units to normally work under corresponding connection relationships, Vmax' is the maximum voltage value of the pulse DC electricity, and during falling of the voltage of the pulse DC electricity from Vmax' to zero, the switches are controlled correspondingly according to corresponding voltage intervals.

According to another aspect of the present invention, the AC mains supply voltage is 220V, the diode voltage drop of each LED is 3V, N=90 and M=6.

According to another aspect of the present invention, the first LED unit includes a switch S1 connected in series with the negative terminal of the LED string in the first LED unit; a second LED unit includes a switch S3 connected in series with a positive terminal of an LED string in the second LED unit and a switch S4 connected in series with a negative terminal of the LED string in the second LED unit; a third LED unit includes a switch S6 connected in series with a positive terminal of an LED string in the third LED unit and a switch S7 connected in series with a negative terminal of the LED string in the third LED unit; a fourth LED unit includes a switch S9 connected in series with a positive terminal of an LED string in the fourth LED unit and a switch S10 connected in series with a negative terminal of the LED string in the fourth LED unit; a fifth LED unit includes a switch S11 connected in series with a positive terminal of an LED string in the fifth LED unit and a switch S13 connected in series with a negative terminal of the LED string in the fifth LED unit; and a sixth LED unit includes a switch S14 connected in series with a positive terminal of an LED string in the sixth LED unit.

According to another aspect of the present invention, there are five connection lines for on/off control in the circuit which includes switches S2, S5, S8, S12 and S15. The switch S2 has a terminal connected with the negative terminal of the LED string in the first LED unit, and another terminal connected with the positive terminal of the LED string in the second LED unit; the switch S5 has a terminal connected with the negative terminal of the LED string in the second LED unit, and another terminal connected with the positive terminal of the LED string in the third LED unit; the switch S8 has a terminal connected with the negative terminal of the LED string in the third LED unit, and another terminal connected with the positive terminal of the LED string in the fourth LED unit; the switch S12 has a terminal connected with the negative terminal of the LED string in the fourth LED unit, and another terminal connected with the positive terminal of the LED string in the fifth LED unit; and the switch S15 has a terminal connected with the negative terminal of the LED string in the fifth LED unit, and another terminal connected with the positive terminal of the LED string in the sixth LED unit.

According to another aspect of the present invention, there are five connection lines for on/off control in the circuit which are diodes D2, D3, D4, D5 and D6, respectively. The diode D2 has an anode connected with the negative terminal of the LED string in the first LED unit, and a cathode connected with the positive terminal of the LED string in the second LED unit; the diode D3 has an anode connected with the negative terminal of the LED string in the second LED unit, and a cathode connected with the positive terminal of the LED string in the third LED unit; the diode D4 has an anode connected with the negative terminal of the LED string in the third LED unit, and a cathode connected with the positive terminal of the LED string in the fourth LED unit; the diode D5 has an anode connected with the negative terminal of the LED string in the fourth LED unit, and a cathode connected with the positive terminal of the LED string in the fifth LED unit; and the diode D6 has an anode connected with the negative terminal of the LED string in the fifth LED unit, and a cathode connected with the positive terminal of the LED string in the sixth LED unit.

According to another aspect of the present invention, during rising of voltage of the pulse DC electricity from V1 to V2, the switches S2, S5 S8, S12 and S15 are open or the diodes D2, D3, D4, D5, and D6 are turned off, and other switches are closed, so that the six LED units are connected in parallel; wherein a forward voltage needed for the LED units is one sixth of a total of forward voltages for all the LEDs if connected in series; during rising of the voltage of the pulse DC electricity from V2 to V3, the switches S1, S3, S7, S9, S13 and S14 are open and other switches in the LED units are closed, and the switches S2, S8 and S15 are closed, and switches S5 and S12 are open, or, the diodes D2, D4, D6 are turned on, and diodes D3 and D5 are turned off, so that the first LED unit and the second LED unit are connected in series, the third LED unit and the fourth LED unit are connected in series, the fifth LED unit and the sixth LED unit are connected in series, and then three resulting unit strings are connected in parallel; wherein a forward voltage needed for the LED units is one third of a total of forward voltages for all the LEDs if connected in series; during rising of the voltage of the pulse DC electricity from V3 to V4, the switches S1, S3, S4, S6, S9, S10, S11, S13 and S14 are open, other switches in the LED units are closed, the switches S2, S5, S12 and S15 are closed, and the switch S8 is open, or the diodes D2, D3, D5 and D6 are turned on and the diodes D4 is turned off, so that the first LED unit, the second unit and the third LED unit are connected in series, the fourth LED unit, the fifth LED unit and the sixth LED unit are connected in series, and then two resulting unit strings are connected in parallel; wherein a forward voltage needed for the LED units is one second of a total of forward voltages for all the LEDs if connected in series; during rising of the voltage of the pulse DC electricity from V4 to Vmax, all the switches in the LED units are open, the switches S2, S5, S8, S12 and S15 are all closed, or all the diodes are turned on, so that all the six LED units are connected in series; wherein a forward voltage needed for the LED units is a total of forward voltages for all the LEDs if connected in series; wherein V1, V2, V3 and V4 are particular voltages in rising edges of the pulse DC electricity, $V1<V2<V3<V4$, and values of V1, V2, V3 and V4 allow all the LED units to normally work under corresponding connection relationships, Vmax is the maximum voltage value of the pulse DC electricity, and during falling of the voltage of the pulse DC electricity from Vmax to zero, the switches are controlled correspondingly according to corresponding voltage intervals.

According to another aspect of the present invention, the circuit further includes a switch control device to detect voltage of the pulse DC electricity and control opening and closing of the switches according to the voltage.

The AC LED driving circuit according to the present invention can overcome shortcomings in prior arts and meanwhile maintain the advantages of old circuits. In one cycle, all the LEDs work, which results in a high utilization of the light emitted by LEDs. Also, full voltage operation is accomplished, that is, all the LEDs work under different voltages, and there is no change in brightness. Thus, the AC LED driving circuit can be applied across the world.

DETAILED DESCRIPTION

In order to make the objectives, technical solutions and advantages of the present invention become clearer, the present invention will be described in detail below using specific embodiments with reference to drawings. It shall be understood that the description is exemplary but not for limiting the scope of the present invention. Further, in the following description, explanations regarding well known structures and technologies are omitted to avoid confusion of conception of the present invention.

Figure 1:
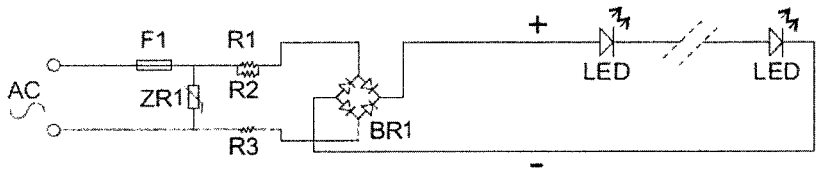
Prior Art Fig. 1
FIG. 1 is a schematic diagram showing a structure of a first-generation AC LED driving circuit in prior arts.

FIG. 1 is a schematic diagram showing a structure of a first-generation AC LED driving circuit in prior arts. As shown in FIG. 1, the main characteristics of this circuit are that resistors are used in the whole circuit to limit current, and the structure of the entire circuit is simple. The defects of the circuit structure are as follows. Resistors are used for limiting current, and thus a lot of electricity energy is consumed on the resistors, thereby resulting in a relative low efficiency of the driving circuit, usually 70%. Further, a lot of heat is generated during operation of the resistors, and the LEDs generate heat during operation, the heat generated by LEDs plus the heat generated by the resistors results in that the first-generation AC driving circuit has to have good heat dissipation ability. Further, the current through the LEDs is not constant, and a relatively large current surge imposed on the LEDs occurs in each operation cycle of the AC mains supply, and this results in shortened lifetimes of the LEDs and more heat generation. When the AC mains supply fluctuates, flicker will occur in the LEDs.

Figure 2:
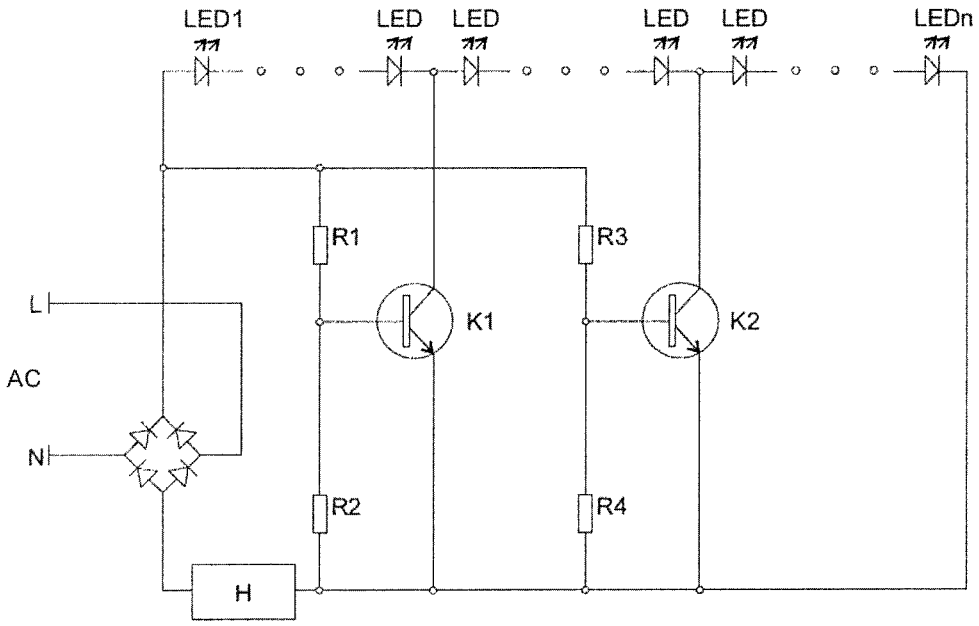
Prior Art Fig. 2
FIG. 2 is a schematic diagram showing a structure of a second-generation AC LED driving circuit in prior arts.

FIG. 2 is a schematic diagram showing a structure of a second-generation AC LED driving circuit in prior arts. The main function of the second-generation AC LED driving circuit is to address the problems with the first-generation AC LED driving circuit. The second-generation AC LED driving circuit operates as follows. The AC mains supply is rectified and then input to a string of LEDs which serve as light sources. Because the voltage changes periodically and thus is not constant, the string of LEDs are divided into a plurality of groups each of which has differing or same number of LEDs. The divided groups of LEDs are connected to a negative terminal of the LED string via a switch (for example, K1 and K2 as shown in FIG. 2). Finally, the negative terminal of the LED string is connected to a constant current unit H for limiting the current flowing through the LEDs. The operations of LEDs vary with the changes of the voltage of the rectified AC mains supply. Specifically, the LEDs work as follows: (1) during rising of the voltage from 0V to the maximum value, the power-on sequence of the LEDs is: firstly, the first group of LEDs are powered on, then the next group of LEDs, finally the last group; (2) during falling of voltage from the maximum value to 0V, the power-off sequence of the LEDs is: firstly, the last group of LEDs are powered off, then the next group of LEDs, and finally the first group of LEDs. Thus, the driving efficiency is increased and thereby a relatively high power factor is realized. Because of a constant current device H, even if the voltage of mains supply fluctuates, the flicker of the LEDs can be reduced. However, the second-generation AC LED driving circuit has a great defect. Because the operation principle of the LEDs determines that not all of the LED strings work during the entire operation cycle, the light output of the LED string frequently changes and the utilization rate of the light output of the LED string is relatively low. Meanwhile, the second-generation AC LED driving circuit does not have a full voltage (85V-265V) operation mode. The second-generation AC LED driving circuit is designed as working under a voltage of 220V, and thus, if the circuit works under a voltage of 110V, not all LEDs can be powered on or off. Further, there are varied AC mains supply voltages across the world, and the second-generation AC LED driving circuit cannot be applied worldwide.

Figure 3:
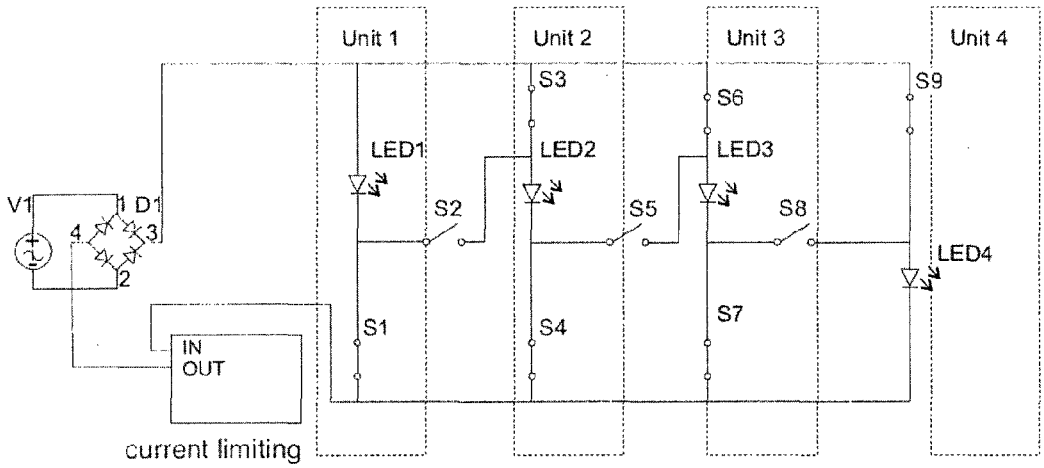
FIG. 3 is a schematic diagram showing a structure of an AC LED driving circuit according to a first embodiment of the present invention.

FIG. 3 is a schematic diagram showing a structure of an AC LED driving circuit according to a first embodiment of the present invention. In the present invention, firstly, the AC mains supply is rectified and then the pulse DC electricity is output, and the pulse DC electricity is input to an LED module, and finally experiences a current-limiting process. The LED module does not use the circuit architecture in the second-generation AC LED driving circuit. Instead, in the LED module of the present invention, the previous one single LED string is changed into LED arrangements in which LEDs can be connected in series or in parallel. In this module, the one single LED sting in the previous second-generation AC LED driving technology is split into different units, one or more LEDs are arranged in each unit, and the total number of the LEDs in one unit does not exceed the total number of the LEDs. The maximum number of LEDs may be computed by:

$$N = \frac{\sqrt{2}\,V_{in}}{V_f}$$

where Vin is AC mains supply voltage, and Vf is a diode voltage drop of a single LED.

All the LEDs in one unit are connected in series. The number of the divided units is one or more, and cannot exceed the total number of LEDs. Then, the divided LED units are connected via switches. In the circuit structure as shown in FIG. 3, the LED string is divided into four units which are connected via switches using different connection approaches.

When the AC mains supply voltage is 220V and the diode voltage drop of each LED is 3.2V, the maximum number of LEDs is $N=\sqrt{2}V_{in}/V_f=1.414*220/3.2=97$. The LEDs are divided evenly into four units, each unit has 24 LEDs and a total of 24*4=96 LEDs are used. The LEDs in each unit are connected in series.

As shown in FIG. 3, V1' is the input AC mains supply, D1 is a rectifier unit, LED1, LED2, LED2 and LED4 are the LEDs assigned into LED units. The unit 1, unit 2, unit 3 and unit 4 are units in which one or more switches are added. There is also a current-limiting unit in the circuit for limiting the current flowing through the LEDs.

In the circuit, firstly, the AC mains supply V1' is rectified by the rectifier unit D1 and then input to LEDs, switches and the current-limiting unit. A switch S1 is connected into the unit 1, two switches, i.e., S3 and S4 are connected into the unit 2, two switches, i.e., S6 and S7 are connected into the unit 3, and a switch S9 is connected into the unit 4.

The switch S1 has a terminal connected with a negative terminal of the LED string in the unit 1, and another terminal connected with an input terminal of the current-limiting unit. The switch S3 has a terminal connected with a positive terminal of the LED string in the unit 2, and another terminal connected with a positive terminal of the rectifier unit. The switch S4 has a terminal connected with a negative terminal of the LED string in the unit 2, and another terminal connected with an input terminal of the current-limiting unit. The switch S6 has a terminal connected with a positive terminal of the LED string in the unit 3, and another terminal connected with a positive terminal of the rectifier unit. The switch S7 has a terminal connected with a negative terminal of the LED string in the unit 3, and another terminal connected with an input terminal of the current-limiting unit. The switch S9 has a terminal connected with a positive terminal of the LED string in the unit 4, and another terminal connected with a positive terminal of the rectifier unit.

Further, the switch S2 has a terminal connected with a negative terminal of the LED string in the unit 1, and another terminal connected with the positive terminal of the LED string in the unit 2. The switch S5 has a terminal connected with a negative terminal of the LED string in the unit 2, and another terminal connected with the positive terminal of the LED string in the unit 3. The switch S8 has a terminal connected with a negative terminal of the LED string in the unit 3, and another terminal connected with a positive terminal of the LED string in the unit 4.

Figure 4A:
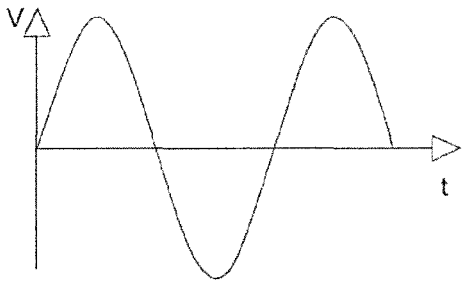
FIG. 4A shows a waveform of AC mains supply.
Figure 4B:
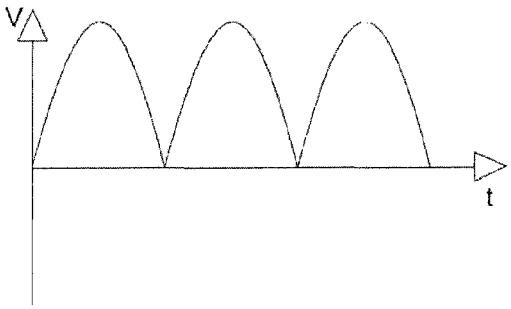
FIG. 4B shows a waveform of pulse DC direct electricity generated after full-bridge rectifying of the AC mains supply.

FIG. 4A shows a waveform of AC mains supply, and FIG. 4B shows a waveform of pulse DC direct electricity generated after full-bridge rectifying of the AC mains supply.

Figure 5:
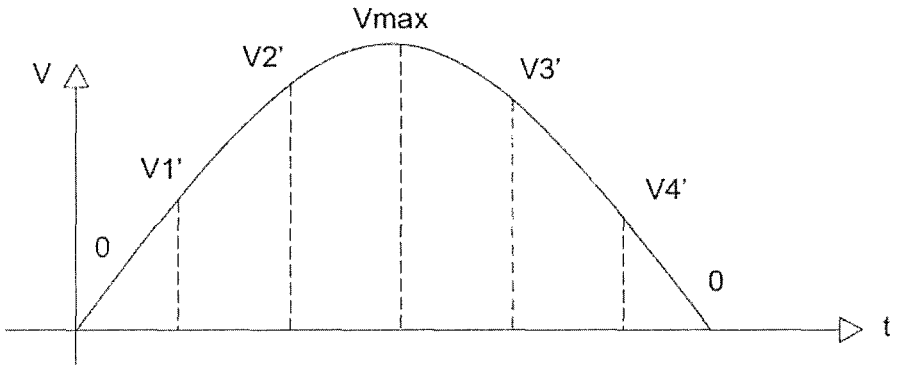
FIG. 5 shows voltage intervals of pulse DC electricity when adjustments are made in the AC LED driving circuit according to the first embodiment of the present invention.

FIG. 5 shows voltage intervals of pulse DC electricity when adjustments are made in the AC LED driving circuit according to the first embodiment of the present invention, in which t represents a time period of one cycle of the pulse DC electricity resulted from rectifying of the AC mains supply, and V represents voltage changes of the pulse DC electricity against time in a cycle. In the time period when the voltage rises from 0V to V1', the unit 1, the unit 2, the unit 3 and the unit 4 are connected in parallel, the switches S2, S5 and S8 are open and other switches are closed. In the time period when the voltage rises from V1' to V2', the unit 1 and the unit 2 are connected in series, and the unit 3 and unit 4 are connected in series, and then the two resulting unit strings connected in parallel are connected to the positive terminal of the rectifier unit and the input terminal of the current-limiting unit. In order to realize the connection, the switches S2 and S8 are closed, and switches S3 and S9 are open. In the time period when the voltage rises from V2' to Vmax', the unit 1, the unit 2, the unit 3 and the unit 4 are connected in series, the switches S2, S5 and S8 are closed, and other switches are open. In the time period when the voltage falls down from Vmax' to V4', the unit 1 and the unit 2 are connected in series, and the unit 3 and the unit 4 are connected in series, and the two resulting unit strings connected in parallel are connected to the positive terminal of the rectifier unit and the input terminal of the current-limiting unit. In order to realize the connection, the switches S2 and S8 are closed, and switches S3 and S9 are open. In the time period when the voltage falls down from V4' to 0V, the unit 1, the unit 2, the unit 3 and the unit 4 are connected in parallel, the switches S2, S5 and S8 are open, and other switches are closed. The voltages of V1', V2', V3' and V4' are determined according to the value of Vf of the LED string in each unit. For example, V1' doubles Vf values of all the LEDs connected serially in one unit, and Vmax' is a forward voltage when all the LEDs are connected in series.

Figure 6:
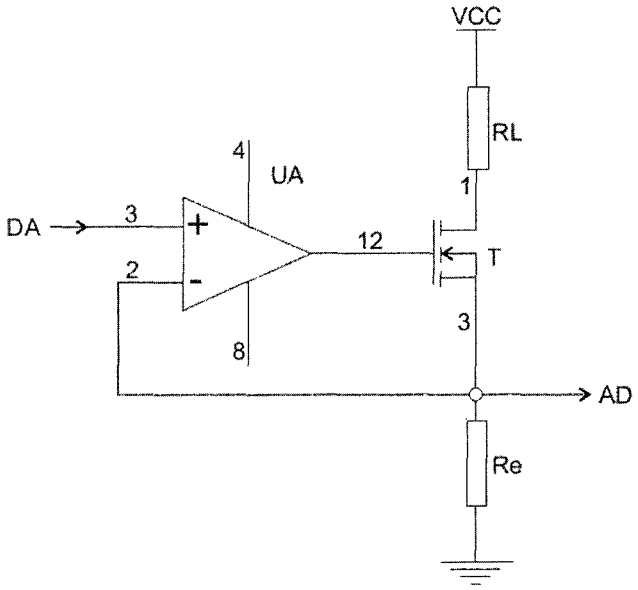
FIG. 6 shows main principles of an example constant current device in embodiments of the present invention.

The input terminal of the current-limiting unit is connected to the negative terminal of the LEDs, and an output terminal of the current-limiting unit is connected to the negative terminal of the rectifier unit. The function of the current-limiting unit is to restrict the current in the whole circuit. FIG. 6 shows main principles of an example constant current device in embodiments of the present invention. As shown in this figure, the constant current device includes an operational amplifier UA, a transistor T, resistors Re and RL. The connection relationships are as follows. An input terminal VCC is connected with a terminal of the resistor RL, and another terminal of the resistor RL is connected with a drain of the transistor T. A terminal of the resistor Re is connected with an output terminal GND, and another terminal of the resistor Re is connected with a source of the transistor T. Meanwhile, an inverting terminal of the operational amplifier is connected with the source of the transistor T, and the output terminal 12 of the operational amplifier is connected with a gate of the transistor T.

The constant current device works as follows. Firstly, a reference source V1' is input to the non-inverting terminal DA of the operational amplifier. When starts operation, the output terminal 12 of the operational amplifier outputs a high level. Thus, the transistor T is in an on state and there is current flowing from the input terminal VCC to GND. Then, a voltage V2' is generated across the resistor Re. When V2'>V1', the output terminal 12 of the operational amplifier is a low level. Thus, the transistor T is in an off state to prevent current from flowing. Then, because there is no current flowing, V2' becomes a low level, V1'>V2', and then the output terminal of the operational amplifier outputs a high level, and the transistor T is in the on state again. In this way, adjustment of current can be realized by adjusting the resistance of Re.

The AC LED driving circuit according to the first embodiment of the present invention can overcome the defects in the second-generation AC LED driving circuit, and meanwhile maintain the advantages of the old circuit. In one cycle, all the LEDs work, and the utilization efficiency of the light emitted from the LEDs is relatively high. Meanwhile, full voltage operation is realized. Under different voltages, all the LEDs work, and there is no change in brightness, and thus the circuit can be applied across the world.

As mentioned above, all the switches are open at the beginning, and then when the voltage of the pulse DC electricity resulted from rectification rises from 0 to V1', switches S1, S3, S4, S6, S7 and S9 are closed, and thus the LED1 unit, the LED2 unit, the LED3 unit and the LED4 unit are connected in parallel. Consequently, the working voltage threshold of the LED strings is reduced into one fourth of the working voltage threshold of the single LED string in the second-generation AC LED driving technology, and meanwhile all the LEDs normally work together.

When the voltage rises from V1' to V2', the switches S2 and S8 are closed, and the switches S1, S3, S7 and S9 are open. Thus, the LED1 unit and the LED2 unit are connected in series, the LED3 unit and the LED4 unit are connected in series, and then the four units are combined into two units, and the two units are connected in parallel. Then, the threshold voltage of the LEDs rises accordingly, and meanwhile all the LEDs work.

When the voltage rises from V2' to Vmax', the switch S5 is closed, and the switches S4 and S6 are open. In this way, the LEDs are reverted back into the original one single LED string, and meanwhile all the LEDs work. In order to guarantee that the working current of the LEDs do not exceed the allowed value, the current-limiting unit is added into the circuit to protect the LEDs.

The voltage starts to fall down after reaching the highest point (Vmax'), before falling down from Vmax to V3', the states of the switches keep unchanged. When the voltage falls down from V3' to V4', the switch S5 is open, and meanwhile the switches S2, S4, S6 and S8 are closed. Then, the LEDs become two parallel units, and thus the working voltage threshold is reduced by a half, and meanwhile all LEDs work.

When the voltage falls down from V4' to 0, the switches S2 and S8 are open, and meanwhile the switches S1, S3, S7 and S9 are closed. In this way, the previous two units are changed into four parallel units. Thus, the working voltage of the LEDs is reduced again, and all the LEDs work, and so on.

The circuit according to the first embodiment of the present invention has following beneficial effects:

(1) The voltage of the generally used mains supply is unstable. In order to prevent the working of the LEDs from influence of the fluctuation of the grid voltage, a current-limiting unit is added into the circuit. In this way, the energy when the voltage is higher than the working voltage of the LEDs is absorbed by the current-limiting unit. Thus, if the rise or falling of the grid voltage is within a certain range (the fluctuation range of grid voltage is ±10%), no flicker will occur.

(2) The AC LED driving circuit solves the problem with the existing AC LED products that the LED products cannot work at multiple voltage ranges (for example, AC220V in China, AC230V, AC110V, AC120V, AC127V in America and Europe), and meanwhile the brightness and power of the LED lighting product under different grid voltages keep unchanged. Thus, such product can be applied across the world.

(3) By using this circuit, the LED product can have a Power Factor (PF) of greater than 0.95, a Total Harmonic Distortion (THD) smaller than 15% and an entire-circuit efficiency η greater than 95%.

(4) The circuit can work under different working frequencies to adapt to grid working frequencies in various countries and areas (frequently used grid frequency is 50 Hz or 60 Hz).

(5) No high frequencies occur in the entire circuit because the circuit works under a power frequency voltage, and no electromagnetic interference is generated, and thus the circuit has good EMC performance.

(6) All the LEDs work in different stages, and the light output from the LED product in respective stages is consistent. In view of the demand that an LED lighting product needs to be compatible with the conventional TRIAC dimmer, when the TRIAC dimmer is used to realize dimming, the duty cycle of the output light is changed to realize adjustment of brightness, and no flicker occurs during dimming. The dimming effects of the circuit of the present invention is better than the second-generation AC LED driving technology because all the LEDs in the present invention emit light, but a part of LEDs in the second-generation AC LED driving technology emit light, and the other LEDs not.

(7) No electrolytic capacitor is used in the whole circuit, and the lifetimes of other electronic elements are longer than the lifetimes of the LEDs, and thus the lifetime of the product using this circuit is longer than the lifetime of the switch-mode power supply in which capacitors are necessary. Meanwhile, the cost is relatively low and the price/performance ratio of the circuit is superior to the first-generation and the second-generation AC LED driving technologies. The circuit has favorable economic value, can greatly reduce the costs, and significantly improve product quality. Thus, the circuit is a good low carbon product.

Figure 7:
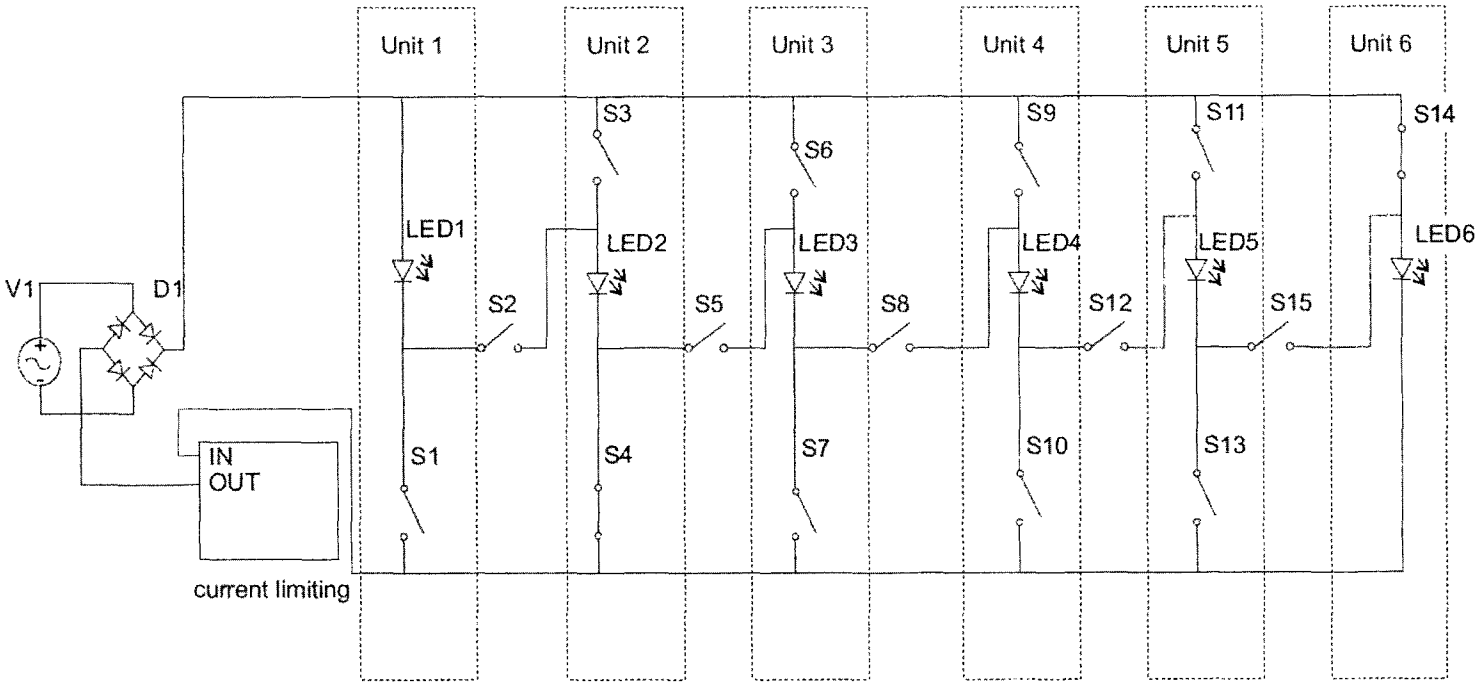
FIG. 7 is a schematic diagram showing a structure of an AC LED driving circuit according to a second embodiment of the present invention.

FIG. 7 is a schematic diagram showing an AC LED driving circuit according to a second embodiment of the present invention. The grid voltage is AC220V, and the frequency is 50 Hz, and thus the number (N) of the LEDs is calculated firstly with the diode voltage drop selected as 3V.

According to the equation:

$$N = \frac{\sqrt{2}\,V_{in}}{V_f}$$

$$N = \sqrt{2} \times 220 \div 3 \approx 103.$$

Preferably, the number is N×0.9≈92.

Then, it can be determined by calculation that the number of the LEDs is 90. The LEDs are divided evenly into six units (preferably, divided evenly, and it is also possible to divide unevenly), each of which includes 15 LEDs which are connected in series as a string. Meanwhile, the switches S1 to S15 connect the six LED units as shown in FIG. 7, and a current-limiting unit is connected in series for limiting the maximum value of the current flowing through the LEDs within the rated current range. The current-limiting unit is finally connected with the pulse DC electricity resulted from full-bridge rectifying of the 220V mains supply.

The number of the divided units in the circuit can be adjusted depending on the condition of the mains supply. For example, the number of the divided units may range from one to N which is the maximum total of LEDs. In the embodiment, in view of the costs and efficiency, the LEDs are divided into six units. In order to realize a relatively reasonable assignment scheme, it is preferable that the numbers of LEDs in respective units are the same. Thus, the number of the switches can be adjusted correspondingly according to the number of the divided units and the connection manner. The circuit can work under AC voltages from 300V to 5V.

Figure 8:
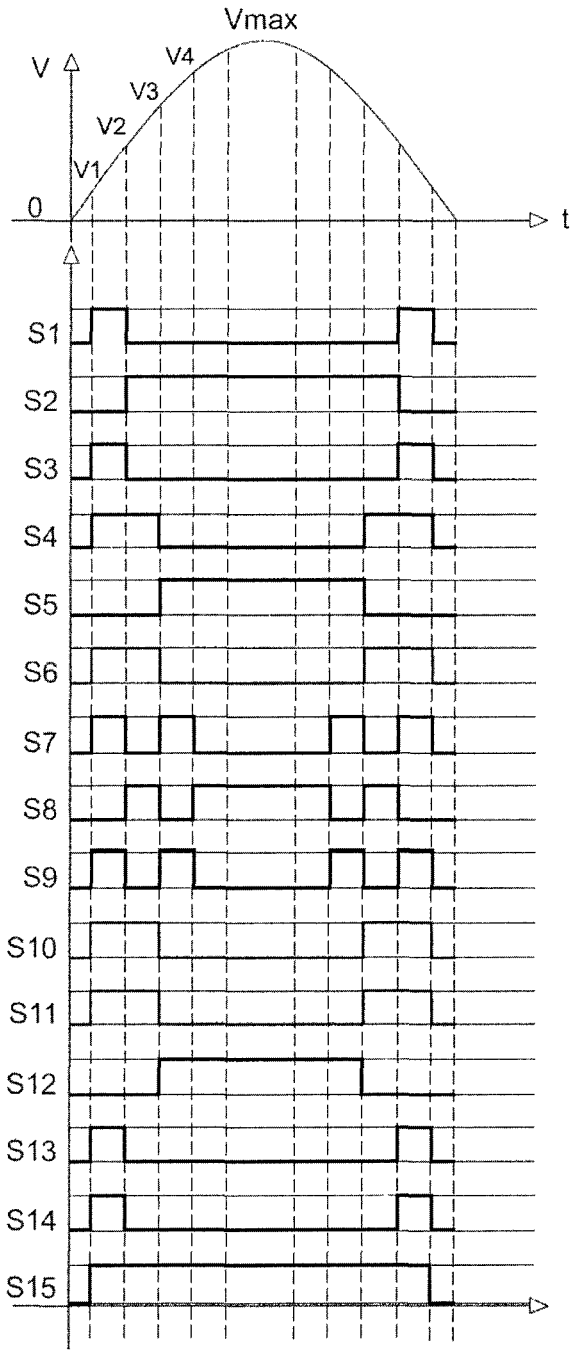
FIG. 8 is a diagram showing states, in different voltage intervals, of respective switches in the AC LED driving circuit according to the second embodiment of the present invention.

FIG. 8 is a diagram showing states, in different voltage intervals, of respective switches in the AC LED driving circuit according to the second embodiment of the present invention, in which 0 represents opening, and 1 represents closing.

During rising of voltage of the pulse DC electricity from V1 to V2, the switches S2, S5, S8, S12 and S15 are open and other switches are closed, so that the six LED units are connected in parallel. A forward voltage needed for the LED units is one sixth of a total of forward voltages for all the LEDs if connected in series.

During rising of the voltage of the pulse DC electricity from V2 to V3, the switches S1, S3, S7, S9, S13 and S14 are open and other switches in the LED units are closed, and the switches S2, S8 and S15 are closed, and the switches S5 and S12 are open, so that the LED1 unit and the LED2 unit are connected in series, the LED3 unit and the LED4 unit are connected in series, the LED5 unit and the LED6 unit are connected in series, and then three resulting unit strings are connected in parallel. A forward voltage needed for the LED units is one third of a total of forward voltages for all the LEDs if connected in series.

During rising of the voltage of the pulse DC electricity from V3 to V4, the switches S1, S3, S4, S6, S9, S10, S11, S13 and S14 are open, other switches in the LED units are closed, the switches S2, S5, S12 and S15 are closed, and the switch S8 is open, so that the LED1 unit, the LED2 unit and the LED3 unit are connected in series, the LED4 unit, the LED5 unit and the LED6 unit are connected in series, and then two resulting unit strings are connected in parallel. A forward voltage needed for the LED units is one second of a total of forward voltages for all the LEDs if connected in series.

During rising of the voltage of the pulse DC electricity from V4 to Vmax, all the switches in the LED units are open, the switches S2, S5, S8, S12 and S15 are all closed, so that all the six LED units are connected in series. A forward voltage needed for the LED units is a total of forward voltages for all the LEDs if connected in series.

During falling of the voltage of the pulse DC electricity from Vmax to zero, the switches are controlled correspondingly according to corresponding voltage intervals.

According to the principle of the present invention, the switches in the circuit can be modified into diodes. FIGS. 9, 10, 11 and 12 are schematic diagrams showing structures of modified embodiments of the second embodiment of the present invention in respective stages. The switches S2, S5, S8, S12, and S15 can be replaced by diodes D2, D3, D4, D5 and D6 so as to further simplify the circuit and reduce costs. The diodes can realize the same working effects.

Figure 9:
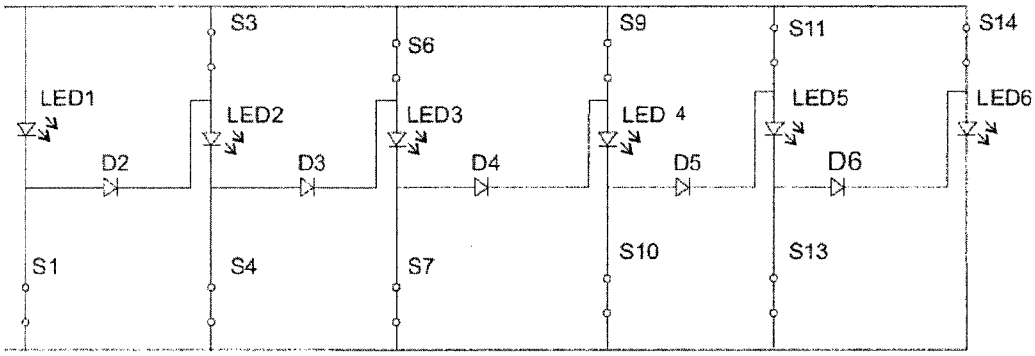
FIGS. 9, 10, 11 and 12 are schematic diagrams showing structures of modified embodiments of the second embodiment of the present invention in respective stages.

As shown in FIG. 9, the LEDs in the six units are connected in parallel (voltage is from V1 to V2): if all the switches are closed and all the diodes for replacing the switches are turned off, the six units are connected in parallel. The forward voltage needed for the LED units is one sixth of a total of forward voltages for all the LEDs if connected in series.

Figure 10:
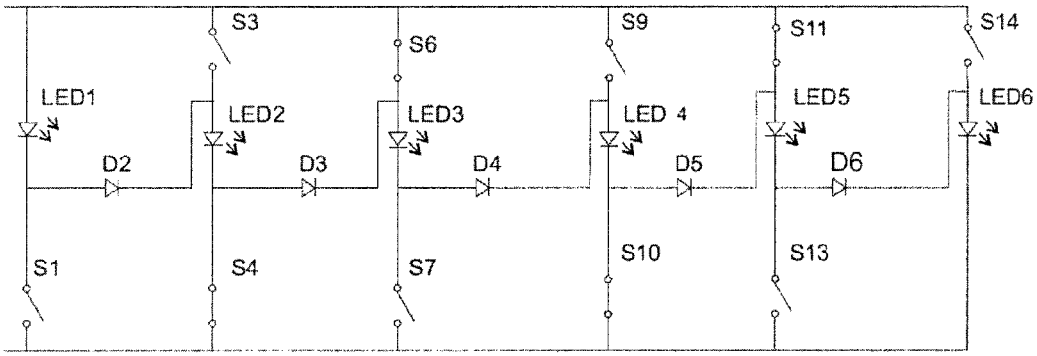

As shown in FIG. 10, every two units are connected in series, and then the resulting unit strings are connected in parallel (the voltage is from V2 to V3). At this time, the switches S1, S3, S7, S9, S13 and S14 open and other switches are closed, and the diodes D2, D4, and D6 are turned on, and the diodes D3 and D5 are turned off. In this way, the LED1 unit and the LED2 unit are connected in series via the diode D2 as a string, the LED3 unit and the LED4 unit are connected in series via the diode D4 as a string, and the LED5 unit and the LED6 unit are connected in series via the diode D6 as a string, and finally the three resulting strings are connected in parallel. The forward voltage needed for the LED units is one third of a total of forward voltages for all the LEDs if connected in series.

Figure 11:
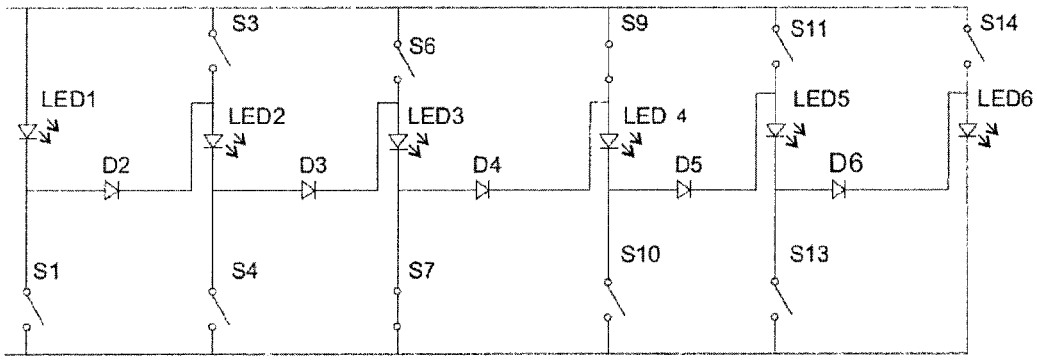

As shown in FIG. 11, every three units are connected in series, and the two resulting unit strings are connected in parallel (the voltage is from V3 to V4). At this time, the switches S1, S3, S4, S6, S10, S11, S13 and S14 are open, and other switches are closed. The diodes D2, D3, D5 and D6 are turned on, and the diode D4 is turned off. In this way, the LED1, LED2 and LED3 units are connected in series via the diodes D2 and D3 as a string, the LED4, LED5 and LED6 units are connected in series via the diodes D5 and D6 as a string, and finally the two resulting unit strings are connected in parallel. The forward voltage needed for the LED units is one second of a total of forward voltages for all the LEDs if connected in series.

Figure 12:
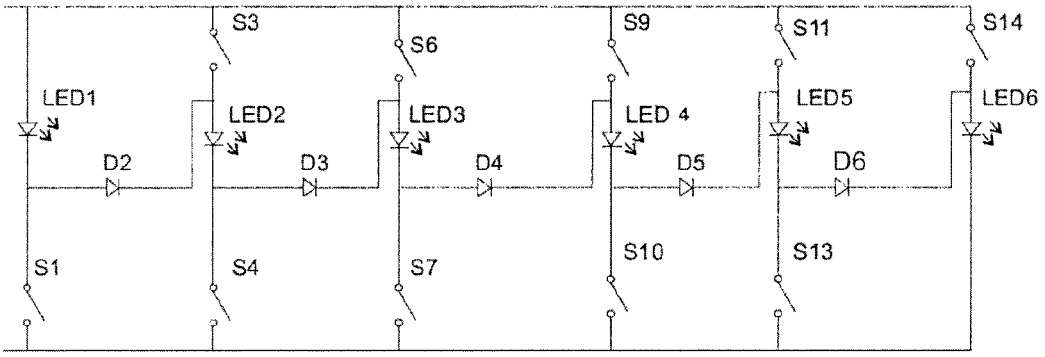

As shown in FIG. 12 (the voltage is from V4 to V5), all the switches are open, and all the diodes are turned on at this time, and the LEDs in the six units are connected in series as a string. The forward voltage needed for the LED units is a total of forward voltages for all the LEDs if connected in series.

Figure 13:
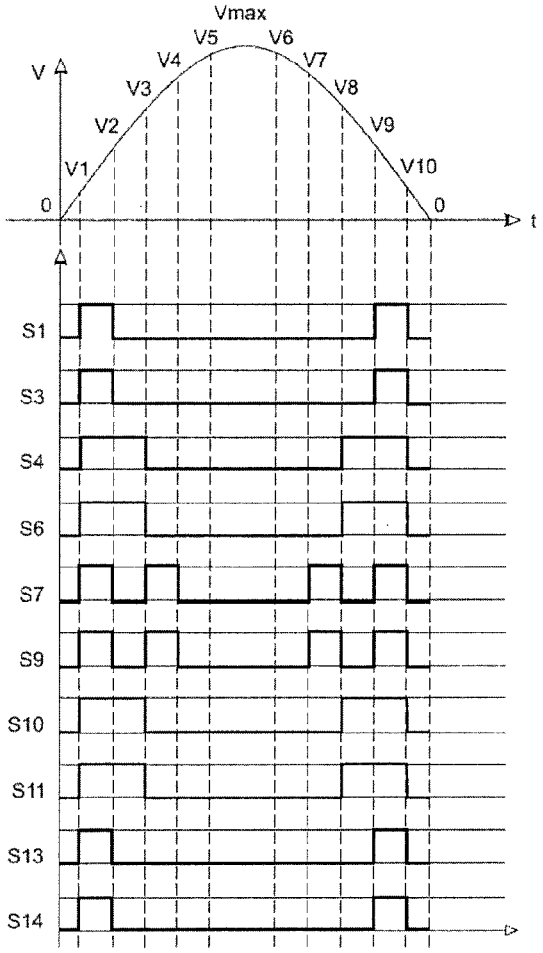
FIG. 13 is a diagram showing states, in different voltage intervals, of respective switches in the AC LED driving circuits according to the modified embodiments.

FIG. 13 is a diagram showing states, in different voltage intervals, of respective switches in the AC LED driving circuits according to the modified embodiments, in which 0 represents opening, and 1 represents closing.

Figure 14:
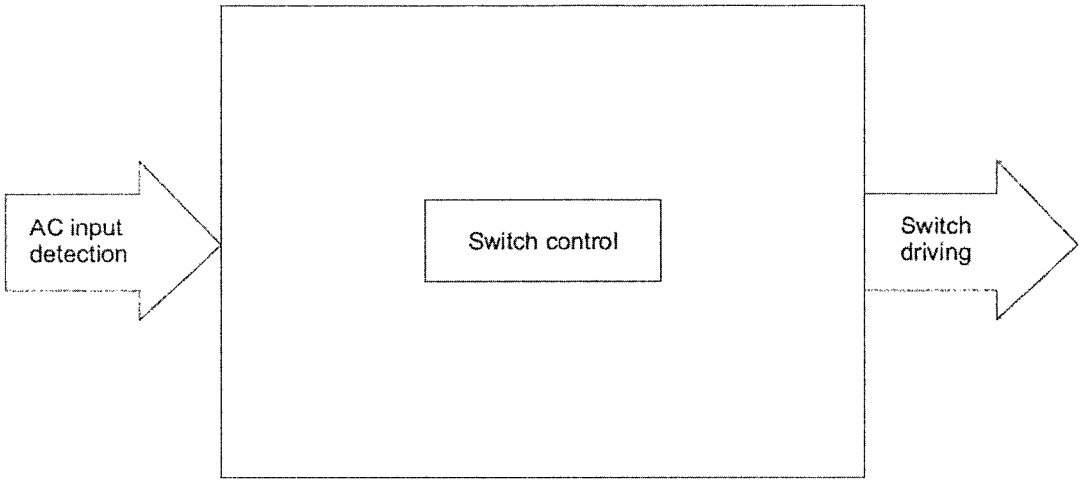
FIG. 14 is a schematic diagram showing switch control in embodiments of the present invention.
Figure 15:
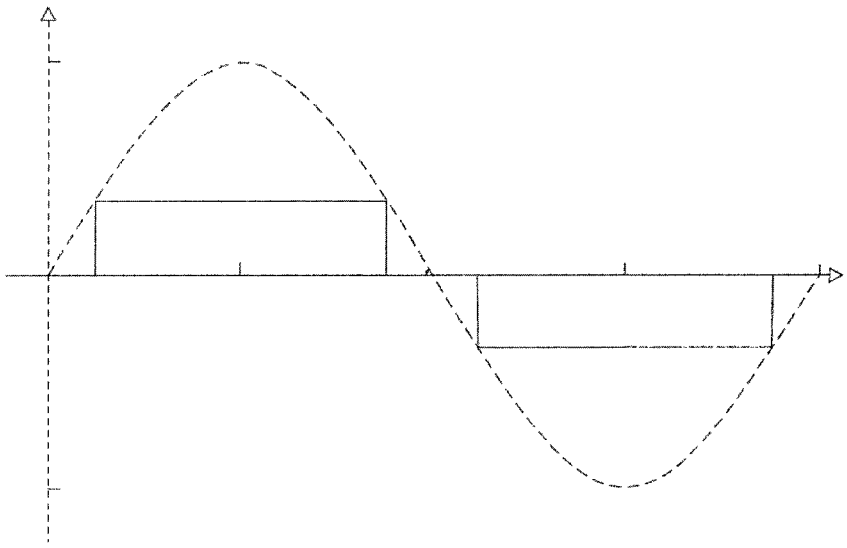
FIG. 15 is a schematic diagram showing a waveform (the dotted line) of electricity in one cycle of AC mains supply and luminous flux (the solid line) of all the LEDs in this cycle according to the present invention.

In practical operation, the circuit needs a switch control device which includes three parts, i.e., a mains supply input detection part, a switch control part and a switch driving part. FIG. 14 is a schematic diagram showing switch control in embodiments of the present invention. The mains supply input detection part detects the voltage of the pulse DC electricity after full-bridge rectifying, the switch control part transmits control signals for respective switches according to the voltage value of the pulse DC electricity and the number of the switches, and the switch driving part converts the control signals into a driving circuit capable of control opening and closing of the switches. FIG. 15 is a schematic diagram showing a waveform (the dotted line) of electricity in one cycle of AC mains supply and luminous flux (the solid line) of all the LEDs in this cycle according to the present invention. FIG. 15 clearly shows the beneficial effects of the present invention.

It should be understood that, the above specific embodiments of the present invention are merely for illustration or explanation of the principle of the present invention, but not for limiting the present invention. Therefore, any modification, equivalent replacement, improvement and the like without departing from the spirit and scope of the present invention falls within the protective scope of the present invention. In addition, the appended claims of the present invention are intended to encompass all the alterations and modifications within the scope and mete of the appended claims and their equivalents.

What is claimed is:

1. An Alternating Current (AC) LED driving circuit, comprising:

a rectifier unit input with AC mains supply to rectify mains supply and output pulse Direct Current (DC);

a current-limiting unit connected in series to the rectifier unit in the circuit to limit current amplitude in the circuit;

M LED units, each of which comprises an LED string of ni LEDs connected in series, $1 \le i \le M$, $n1+n2+ \ldots +nM=N$, $1 \le M \le N$, wherein N is determined by the following equation:

$$N = \frac{\sqrt{2}\, V_{in}}{V_f}$$

wherein M, N, i, n and ni are integers, wherein Vin is AC mains supply voltage, Vf is a diode voltage drop of a single LED, wherein the M LED units are arranged sequentially, each of which has: a terminal, which is close to a positive terminal of its LED string, connected to a positive terminal of the rectifier unit; and another terminal, which is close to a negative terminal of its LED string, connected to the current-limiting unit which is connected to a negative terminal of the rectifier unit; wherein, among the M LED units, a first LED unit comprises a switch connected in series with a negative terminal of an LED string in the first LED unit, an i-th LED unit comprises a switch connected in series with a positive terminal of an LED string in the i-th LED unit and a switch connected in series with a negative terminal of the LED string in the i-th LED unit, $1 \le i \le M-1$, and an M-th LED unit comprises a switch connected in series with a positive terminal of an LED string in the M-th LED unit; and M−1 connection lines for on/off control, each of which has a terminal connected with the negative terminal of the LED string in the i-th LED unit, and another terminal connected with a positive terminal of an LED string in an (i+1)-th LED unit, $1 \le i \le M-1$, wherein on or off of the M−1 connection lines determines layouts of the circuit;

wherein series and parallel connection states of respective LED units are changed by changing closed and open states of respective switches and on and off states of the connection lines, so that all LEDs normally work over respective voltage ranges of pulse DC electricity.

2. The AC LED driving circuit according to claim 1, wherein the AC mains supply voltage is 220V, the diode voltage drop of each LED is 3.2 V, N=96, and M=4.

3. The AC LED driving circuit according to claim 2, wherein:

the first LED unit comprises a switch (S1) connected in series with the negative terminal of the LED string in the first LED unit;

a second LED unit comprises a switch (S3) connected in series with a positive terminal of an LED string in the second LED unit and a switch (S4) connected in series with a negative terminal of an LED string in the second LED unit;

a third LED unit comprises a switch (S6) connected in series with a positive terminal of an LED string in the third LED unit and a switch (S7) connected in series with a negative terminal of an LED string in the third LED unit; and a fourth LED unit comprises a switch (S9) connected in series with a positive terminal of an LED string in the fourth LED unit.

4. The AC LED driving circuit according to claim 3, wherein there are three connection lines for on/off control in the circuit which comprise switches (S2, S5, S8); wherein:

the switch (S2) has a terminal connected with the negative terminal of the LED string in the first LED unit, and another terminal connected with the positive terminal of the LED string in the second LED unit;

the switch (S5) has a terminal connected with the negative terminal of the LED string in the second LED unit, and another terminal connected with the positive terminal of the LED string in the third LED unit; and the switch (S8) has a terminal connected with the negative terminal of the LED string in the third LED unit, and another terminal connected with the positive terminal of the LED string in the fourth LED unit.

5. The AC LED driving circuit according to claim 4, wherein:

during rising of voltage of the pulse DC electricity from 0V to V1', the switches (S2, S5, S8) are open, and other switches are closed, so that the first LED unit, the second LED unit, the third LED unit and the fourth LED unit are connected in parallel;

during rising of the voltage of the pulse DC electricity from V1' to V2', the switches (S2, S4, S6, S8) are closed, and the switches (S1, S3, S5, S7, S9) are open, so that the first LED unit and the second LED unit are connected in series, and the third LED unit and the fourth LED unit are connected in series, and then two resulting unit strings are connected in parallel;

during rising of the voltage of the pulse DC electricity from V2' to Vmax', the switches (S2, S5, S8) are closed, and other switches are open, so that the first LED unit, the second unit, the third LED unit and the fourth LED unit are connected in series;

wherein V1' and V2' are particular voltages in rising edges of the pulse DC electricity, V1'<V2', and values of V1' and V2' allow all the LED units to normally work under corresponding connection relationships, Vmax' is the maximum voltage value of the pulse DC electricity, and during falling of the voltage of the pulse DC electricity from Vmax' to zero, the switches are controlled correspondingly according to corresponding voltage intervals.

6. The AC LED driving circuit according to claim 4, wherein the circuit further comprises a switch control device to detect voltage of the pulse DC electricity and control opening and closing of the switches according to the voltage.

7. The AC LED driving circuit according to claim 1, wherein the AC mains supply voltage is 220V, the diode voltage drop of each LED is 3V, N=90 and M=6.

8. The AC LED driving circuit according to claim 7, wherein:

the first LED unit comprises a switch (S1) connected in series with the negative terminal of the LED string in the first LED unit;

a second LED unit comprises a switch (S3) connected in series with a positive terminal of an LED string in the second LED unit and a switch (S4) connected in series with a negative terminal of the LED string in the second LED unit;

a third LED unit comprises a switch (S6) connected in series with a positive terminal of an LED string in the third LED unit and a switch (S7) connected in series with a negative terminal of the LED string in the third LED unit;

a fourth LED unit comprises a switch (S9) connected in series with a positive terminal of an LED string in the fourth LED unit and a switch (S10) connected in series with a negative terminal of the LED string in the fourth LED unit;

a fifth LED unit comprises a switch (S11) connected in series with a positive terminal of an LED string in the fifth LED unit and a switch (S13) connected in series with a negative terminal of the LED string in the fifth LED unit; and a sixth LED unit comprises a switch (S14) connected in series with a positive terminal of the LED string in the sixth LED unit.

9. The AC LED driving circuit according to claim 8, wherein there are five connection lines for on/off control in the circuit which comprise switches (S2, S5, S8, S12, S15); wherein:

the switch (S2) has a terminal connected with the negative terminal of the LED string in the first LED unit, and another terminal connected with the positive terminal of the LED string in the second LED unit;

the switch (S5) has a terminal connected with the negative terminal of the LED string in the second LED unit, and another terminal connected with the positive terminal of the LED string in the third LED unit;

the switch (S8) has a terminal connected with the negative terminal of the LED string in the third LED unit, and another terminal connected with the positive terminal of the LED string in the fourth LED unit;

the switch (S12) has a terminal connected with the negative terminal of the LED string in the fourth LED unit, and another terminal connected with the positive terminal of the LED string in the fifth LED unit; and the switch (S15) has a terminal connected with the negative terminal of the LED string in the fifth LED unit, and another terminal connected with the positive terminal of the LED string in the sixth LED unit.

10. The AC LED driving circuit according to claim 9, wherein:

during rising of voltage of the pulse DC electricity from V1 to V2, the switches (S2, S5, S8, S12, S15) are open or the diodes (D2, D3, D4, D5, D6) are turned off, and other switches are closed, so that the six LED units are connected in parallel; wherein a forward voltage needed for the LED units is one sixth of a total of forward voltages for all the LEDs if connected in series;

during rising of the voltage of the pulse DC electricity from V2 to V3, the switches (S1, S3, S7, S9, S13, S14) are open and other switches in the LED units are closed, and the switches (S2, S8, S15) are closed, and the switches (S5, S12) are open, or, the diodes (D2, D4, D6) are turned on, and diodes (D3, D5) are turned off, so that the first LED unit and the second LED unit are connected in series, the third LED unit and the fourth LED unit are connected in series, the fifth LED unit and the sixth LED unit are connected in series, and then three resulting unit strings are connected in parallel; wherein a forward voltage needed for the LED units is one third of a total of forward voltages for all the LEDs if connected in series;

during rising of the voltage of the pulse DC electricity from V3 to V4, the switches (S1, S3, S4, S6, S10, S11, S13, S14) are open, other switches in the LED units are closed, the switches (S2, S5, S12, S15) are closed, and the switch (S8) is open, or the diodes (D2, D3, D5, D6) are turned on and the diodes (D4) is turned off so that the first LED unit, the second LED unit and the third LED unit are connected in series, the fourth LED unit, the fifth LED unit and the sixth LED unit are connected in series, and then two resulting unit strings are connected in parallel; wherein a forward voltage needed for the LED units is one second of a total of forward voltages for all the LEDs if connected in series;

during rising of the voltage of the pulse DC electricity from V4 to Vmax, all the switches in the LED units are open, the switches (S2, S5, S8, S12, S15) are all closed, or all the diodes are turned on, so that all the six LED units are connected in series; wherein a forward voltage needed for the LED units is a total of forward voltages for all the LEDs if all connected in series;

wherein V1, V2, V3 and V4 are particular voltages in rising edges of the pulse DC electricity, V1<V2<V3<V4, and values of V1, V2, V3 and V4 allow all the LED units to normally work under corresponding connection relationships, Vmax is the maximum voltage value of the pulse DC electricity, and during falling of the voltage of the pulse DC electricity from Vmax to zero, the switches are controlled correspondingly according to corresponding voltage intervals.

11. The AC LED driving circuit according to claim 9, wherein the circuit further comprises a switch control device to detect voltage of the pulse DC electricity and control opening and closing of the switches according to the voltage.

12. The AC LED driving circuit according to claim 8, wherein there are five connection lines for on/off control in the circuit which comprise diodes (D2, D3, D4, D5, D6); wherein:

the diode (D2) has an anode connected with the negative terminal of the LED string in the first LED unit, and a cathode connected with the positive terminal of the LED string in the second LED unit;

the diode (D3) has an anode connected with the negative terminal of the LED string in the second LED unit, and a cathode connected with the positive terminal of the LED string in the third LED unit;

the diode (D4) has an anode connected with the negative terminal of the LED string in the third LED unit, and a cathode connected with the positive terminal of the LED string in the fourth LED unit;

the diode (D5) has an anode connected with the negative terminal of the LEI) string in the fourth LED unit, and a cathode connected with the positive terminal of the LED string in the fifth LED unit; and the diode (D6) has an anode connected with the negative terminal of the LED string in the fifth LED unit, and a cathode connected with the positive terminal of the LED string in the sixth LED unit.

13. The AC LED driving circuit according to claim 12, wherein:

during rising of voltage of the pulse DC electricity from V1 to V2, the switches (S2, S5, S8, S12, S15) are open or the diodes (D2, D3, D4, D5, D6) are turned off, and other switches are closed, so that the six LED units are connected in parallel; wherein a forward voltage needed for the LED units is one sixth of a total of forward voltages for all the LEDs if connected in series;

during rising of the voltage of the pulse DC electricity from V2 to V3, the switches (S1, S3, S7, S9, S13, S14) are open and other switches in the LED units are closed, and the switches (S2, S8, S15) are closed, and the switches (S5, S12) are open, or, the diodes (D2, D4, D6) are turned on, and diodes (D3, D5) are turned off, so that the first LED unit and the second LED unit are connected in series, the third LED unit and the fourth LED unit are connected in series, the fifth LED unit and the sixth LED unit are connected in series, and then three resulting unit strings are connected in parallel; wherein a forward voltage needed for the LED units is one third of a total of forward voltages for all the LEDs if connected in series;

during rising of the voltage of the pulse DC electricity from V3 to V4, the switches (S1, S3, S4, S6, S10, S11, S13, S14) are open, other switches in the LED units are closed, the switches (S2, S5, S12, S15) are closed, and the switch (S8) is open, or the diodes (D2, D3, D5, D6) are turned on and the diodes (D4) is turned off, so that the first LED unit, the second LED unit and the third LED unit are connected in series, the fourth LED unit, the fifth LED unit and the sixth LED unit are connected in series, and then two resulting unit strings are connected in parallel; wherein a forward voltage needed for the LED units is one second of a total of forward voltages for all the LEDs if connected in series;

during rising of the voltage of the pulse DC electricity from V4 to Vmax, all the switches in the LED units are open, the switches (S2, D5, S8, S12, S15) are all closed, or all the diodes are turned on, so that all the six LED units are connected in series; wherein a forward voltage needed for the LED units is a total of forward voltages for all the LEDs if all connected in series;

wherein V1, V2, V3 and V4 are particular voltages in rising edges of the pulse DC electricity, V1<V2<V3<V4, and values of V1, V2, V3 and V4 allow all the LED units to normally work under corresponding connection relationships, Vmax is the maximum voltage value of the pulse DC electricity, and during falling of the voltage of the pulse DC electricity from Vmax to zero, the switches are controlled correspondingly according to corresponding voltage intervals.

14. The AC LED driving circuit according to claim 1, wherein the circuit further comprises a switch control device to detect voltage of the pulse DC electricity and control opening and closing of the switches according to the voltage.

* * * * *